US006604577B2

(12) United States Patent
Mulder

(10) Patent No.: US 6,604,577 B2
(45) Date of Patent: Aug. 12, 2003

(54) GEOTHERMAL HEAT PUMP CLEANING CONTROL SYSTEM AND METHOD

(76) Inventor: Eric P. Mulder, 124 43rd St., SE., Kentwood, MI (US) 49548

( * ) Notice: Subject to any disclaimer, the term of this patent is extended or adjusted under 35 U.S.C. 154(b) by 0 days.

(21) Appl. No.: 09/730,162

(22) Filed: Dec. 5, 2000

(65) Prior Publication Data

US 2002/0066555 A1 Jun. 6, 2002

(51) Int. Cl.[7] ..... F28G 1/00; F25D 21/06

(52) U.S. Cl. ..... 165/303; 165/95; 165/45; 62/80; 62/155; 62/156; 62/278

(58) Field of Search ..... 165/95, 303, 45; 62/80, 81, 82, 155, 156, 160, 238.6, 238.7, 260, 278

(56) References Cited

U.S. PATENT DOCUMENTS

| | | | | | |
|---|---|---|---|---|---|
| 2,954,680 | A | * | 10/1960 | Ruff | 165/45 X |
| 3,319,704 | A | * | 5/1967 | Nasse | 165/95 |
| 3,918,268 | A | * | 11/1975 | Nussbaum | 62/80 X |
| 3,968,833 | A | * | 7/1976 | Strindehag et al. | 62/82 X |
| 4,091,636 | A | * | 5/1978 | Margen | 165/45 X |
| 4,143,702 | A | * | 3/1979 | Barr, Jr. | 165/95 X |
| 4,176,708 | A | * | 12/1979 | Joffe | 165/95 |
| 4,217,218 | A | * | 8/1980 | Bauer | 165/95 X |
| 4,257,239 | A | * | 3/1981 | Partin et al. | 165/45 X |
| 4,336,692 | A | * | 6/1982 | Ecker et al. | 62/82 |
| 4,407,137 | A | * | 10/1983 | Hayes, Jr. | 62/80 |
| 4,468,930 | A | * | 9/1984 | Johnson | 165/95 X |
| 4,538,418 | A | | 9/1985 | Lawrence et al. | |
| 4,577,677 | A | * | 3/1986 | Ezzell | 165/95 |
| 4,593,748 | A | * | 6/1986 | Kramb | 165/95 X |
| 4,882,908 | A | | 11/1989 | White | |
| 4,911,229 | A | | 3/1990 | McElroy | |
| 4,928,498 | A | * | 5/1990 | Gossler | 62/82 X |
| 4,951,473 | A | * | 8/1990 | Levine et al. | 62/82 |
| 4,993,483 | A | * | 2/1991 | Harris | 165/45 |
| 5,021,096 | A | | 6/1991 | Abadi | |
| 5,137,081 | A | * | 8/1992 | Klaren | 165/95 |
| 5,190,095 | A | * | 3/1993 | Fujimoto et al. | 165/303 X |
| 5,214,935 | A | * | 6/1993 | Brunskill | 62/80 X |
| 5,388,419 | A | * | 2/1995 | Kaye | 165/45 X |
| 5,515,689 | A | * | 5/1996 | Atterbury | 62/80 |
| 5,634,515 | A | | 6/1997 | Lambert | |
| 5,642,964 | A | | 7/1997 | DeMasters | |
| 5,706,888 | A | * | 1/1998 | Ambs et al. | 165/45 X |
| 5,727,395 | A | * | 3/1998 | Guo et al. | 62/80 X |
| 5,758,514 | A | | 6/1998 | Genung et al. | |
| 5,885,364 | A | | 3/1999 | Hieatt et al. | |
| 5,895,763 | A | | 4/1999 | Edstrand et al. | |

FOREIGN PATENT DOCUMENTS

| | | | | |
|---|---|---|---|---|
| DE | 208 208 | * | 3/1984 | 62/80 |

OTHER PUBLICATIONS

Luscombe, R.H., "Methods of Defrosting Commercial Refrigerating Equipment", Penn Electric Switch Co., R.S.E.S. Dallas Educational Conference, Jan. 26–28, 1951, pp 1–6.*

* cited by examiner

*Primary Examiner*—Ljiljana Ciric
(74) *Attorney, Agent, or Firm*—Young & Basile, P.C.

(57) ABSTRACT

An apparatus for removing deposits from a heat transfer wall of a heat exchanger. The apparatus includes a cleaning cycle control system that operates through the control system of the heat pump and eliminates the need for periodic acid cleaning of heat exchanger. The cleaning cycle control system engages a heating cycle of the heat pump to at least partially freeze the fluid adjacent to the heat transfer wall and then engages the cooling cycle of the heat pump to thaw the fluid adjacent to the heat transfer wall. The thermal expansion and contraction of the deposits on the heat transfer wall and the flow of fluids through the heat exchanger flush deposits from the heat transfer wall of the heat exchanger.

21 Claims, 4 Drawing Sheets

GEOTHERMAL HEAT PUMP CLEANING CONTROL SYSTEM AND METHOD

FIELD OF THE INVENTION

The present invention relates to an apparatus and method for cleaning the interior of a heat exchanger by controlling the flow of separate fluids flowing through separate fluid conduits of the heat exchanger.

BACKGROUND OF THE INVENTION

One of the known methods of cleaning a heat pump is an acid cleaning process. One gallon of muriatic acid is mixed with three gallons of water to create a 25% muriatic acid solution in a five gallon plastic bucket. The water inlet and outlet hoses are disconnected from the heat pump. An acid pump is positioned within the five gallon plastic bucket with an outlet hose connected to the outlet of the heat pump, while another hose is connected to the inlet of the heat pump for discharging the 25% muriatic acid solution back into the five gallon plastic bucket while being recirculated by the acid pump. The pump is selected with components to tolerate a 25% muriatic acid solution. The 25% muriatic acid solution is circulated through the heat pump in through the outlet port and out through the inlet port for 20–30 minutes. The heat pump is then flushed with pure water. The water inlet and outlet hoses are then reconnected to the heat pump. This process requires extreme caution when handling muriatic acid. The operator is required to wear eye protection and protective gloves, and it is recommended to only be performed by a trained technician.

Ground water heat pump installations can require cleaning on a regular basis due to poor quality ground water. Water treatment normally is not an option due to the large amounts of water used with ground water heat pump installations as opposed to a closed loop system. The normal course of cleaning is to require acid cleaning of the water coil or heat recovery unit. If scaling of the coil is suspected, the coil can be cleaned with a solution of phosphoric acid (food grade acid).

The instructions typically indicate that the manufacturer's directions for mixing, use, etc. should be followed. The acid solution can be introduced into the heat pump coil through a hose bib. The isolation valves are closed to prevent contamination of the rest of the system by the acid. The acid is pumped from a bucket into the hose bib and returned to the bucket through the other hose bib. The standard instructions typically indicate that the manufacturer's directions for the product used should be consulted to determine how long the solution is to be circulated, but is usually circulated for a period of several hours.

SUMMARY OF THE INVENTION

The present invention provides an apparatus for removing deposits that accumulate on an interior surface of a heat exchanger. The apparatus removes deposits by controlling the flow of the separate fluids that concurrently pass through the heat exchanger. The heat exchanger includes a heat transfer wall that separates the flow of the two fluids. The flows of the respective fluids are controlled by control means. The cleaning cycle control system, through the control means, engages a heating cycle so that a first fluid draws heat from the second fluid through the heat transfer wall. The second fluid begins to freeze along the heat transfer wall. The deposits located on the heat transfer wall, on the side of the second fluid, also begin to freeze. After the freezing process has progressed for a period of time, the cleaning cycle control system, through the control means, reverses the flow of the first fluid so that heat is directed toward the second fluid. Frozen deposits positioned on the wall begin to thaw. The thawing process causes the deposits to separate from the heat transfer wall. The flow of the second fluid carries the deposits away from the heat exchanger. The present invention can also include a solenoid water valve positioned within the second fluid conduit. When the cooling cycle is actuated to thaw the frozen deposits, the solenoid valve is reactivated. The present invention also provides means for disengaging a freeze switch or pressure switch to allow the heat transfer wall to at least partially freeze. Disengaging the switch allows the cleaning cycle control system, through the control means, to operate without interruption by the switch. The present invention also provides means for automatically engaging the cleaning cycle control system, through the control means, after the heat exchanger has operated for a predetermined period of time.

The present invention provides a method for cleaning a heat transfer wall in a heat exchanger. A heating cycle is engaged to draw heat from a fluid in the heat exchanger. The heat is drawn from the fluid through a heat transfer wall. Fluid immediately adjacent to the heat transfer wall and deposits on the heat transfer wall at least partially freeze. The heating cycle is reversed and heat is absorbed by the fluid so that the fluid and deposits adjacent to the heat transfer wall thaw and separate from the heat transfer wall. The present invention also provides the step of shutting off the flow of fluid through the heat exchanger while the freezing process is proceeding. Also, the present invention provides the step of disengaging a freeze switch operably associated with the heat exchanger to prevent the heating cycle from shutting down before a predetermined period of time has transpired. In addition, the present invention also provides the step of automatically engaging the cleaning process for the heat exchanger after the heat exchanger has operated for a predetermined period of time.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
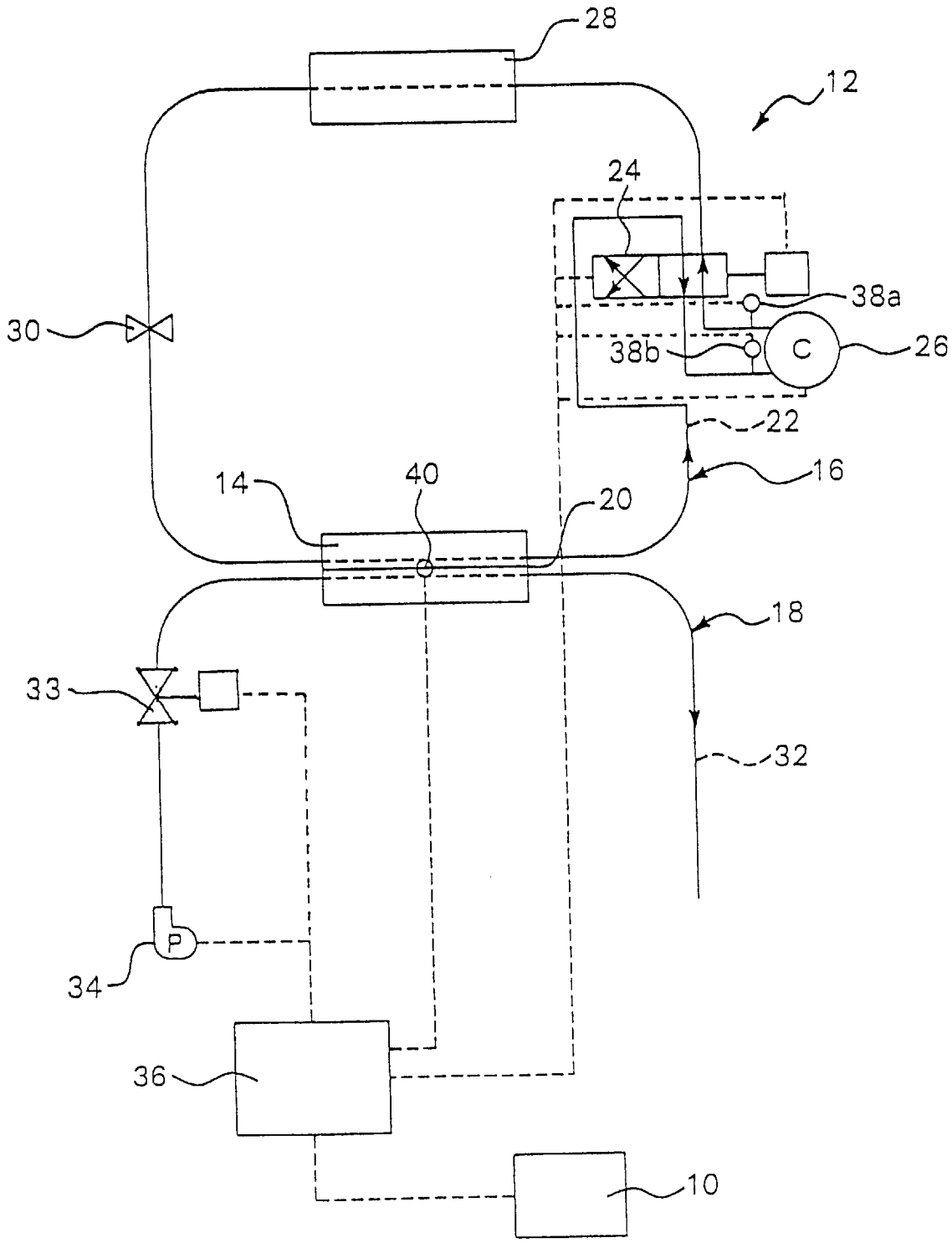
FIG. 1 is a schematic diagram of a heat pump according to the present invention.

The present invention provides a cleaning cycle control system 10 for a heat pump 12. As is shown in FIG. 1, the heat pump 12 includes a heat exchanger 14, a first fluid conduit 16 and a second fluid conduit 18. The first fluid conduit 16 and second fluid conduit 18 pass adjacent to one another through the heat exchanger 14 and are separated by a heat transfer wall 20.

The first fluid conduit 16 creates a path for a first fluid 22. In a preferred embodiment of the present invention, the first fluid conduit 16 is a reversible closed loop system and the first fluid 22 passes through the heat exchanger 14, a reversing valve 24, a compressor 26, a second heat exchanger 28, and an expansion valve 30. However, the present invention can include any configuration of heat pump known to those skilled in the art.

The first fluid 22 can be a refrigerant. Examples of suitable refrigerants include freon, ammonia, water, air, methylene chloride, methyl chloride, sulphur dioxide, propane, ethane, ethyl chloride, and carbon dioxide. In addition, any other refrigerant known to those skilled in the art can be used in the present invention without departing from the spirit and scope of the invention disclosed herein. The flow of the first fluid 22 through the first fluid conduit 16 is controlled by the reversing valve 24. The compressor 26 compresses the first fluid 22 and forces the first fluid 22 towards the reversing valve 24. The reversing valve 24 then directs the first fluid 22 towards either the heat exchanger 14 or the second heat exchanger 28. The direction of the flow establishes whether the heat pump 12 is operating in a heating cycle or a cooling cycle. If the heat pump 12 is operating in a heating cycle mode, the first fluid 22 is directed by the reversing valve 24 towards the second heat exchanger 28. The first fluid 22 releases heat at the second heat exchanger 28 and absorbs heat at the heat exchanger 14. In a cooling cycle, the process is reversed. The compressor 26 directs the first fluid 22 to the reversing valve 24 and the reversing valve 24 directs the first fluid 22 towards the heat exchanger 14. The first fluid 22 releases heat at the heat exchanger 14 and absorbs heat at the second heat exchanger 28.

The second fluid conduit 18 creates a path for a second fluid 32. The second fluid conduit 18 can include a pump 34. In a preferred embodiment of the present invention, the second fluid conduit is an open loop system. However, the present invention can include the second fluid conduit being a closed loop system. The second fluid 32 is used as a "heat sink" in one mode of operation. As used herein, the term "heat sink" refers to a part of a system at a lower temperature than the surroundings and used to dissipate heat from the system. For example, heat is being drawn from the second fluid 32 during a heating cycle of the heat pump 12, and heat is being directed toward the second fluid 32 during a cooling cycle of the heat pump 12. Examples of a suitable heat sink fluids include air, water, and coolant, and mixtures thereof. In a geothermal heat pump, water is used as the second fluid 32. The pump 34 draws ground water from underground and forces the water through the heat exchanger 14. The second fluid 32 can contain contaminants such as soluble minerals and other particles in suspension or various levels of concentration. These contaminants can settle on the interior surfaces of the second fluid conduit 18, including the surface of the heat transfer wall 20. The accumulation of deposits on the heat transfer wall 20 reduces the efficiency of the heat pump 12. As a result, it is desirable to periodically clean the second fluid conduit 18 to remove these deposits and increase efficiency of the heat transfer process.

The operation of the heat pump 12 in a heating cycle or a cooling cycle is determined by the direction of the flow of the first fluid 22. Also, the reversing valve 24 controls the direction of the flow of the first fluid 22. The heat pump 12 can include control means 36 for controlling the operation of the reversing valve 24 and, in turn, the operation of the heat pump 12 for selectively operating a heating cycle or a cooling cycle in response to the control system. The heat pump 12 can also include other elements that can also be controlled by the control means 36. For example, the heat pump 12 can include one or more low pressure switches 38*a* and 38*b*. The low pressure switches 38*a* and 38*b* can be positioned adjacent to the compressor 26 to monitor the pressure of the first fluid 22 as the first fluid 22 enters or exits the compressor 26.

The heat pump 12 can also include a freeze switch 40. The freeze switch 40 is operably positioned adjacent to the heat exchanger 14 or within the heat exchanger 14. The freeze switch 40 can determine if the heat exchanger 14 is freezing. During the heating cycle, heat is drawn from the second fluid 32 and into the first fluid 22. Continuous operation of the heating cycle can cause a layer of ice to form on the heat transfer wall 20. When a cooling cycle is engaged, heat is drawn from the first fluid 22 and into the second fluid 32 to melt any ice that has formed on the heat transfer wall 20.

The present invention includes a cleaning cycle control system 10. The cleaning cycle control system 10 is operable through the control means 36. As used herein, the term "operable through" means that the cleaning cycle control system 10 uses the existing control means 36 of the heat pump 12, and the existing first and second fluids 22 and 32, respectively, to clean the heat transfer wall 20. Prior known cleaning systems typically required the use of an additional pump and different fluids. For example, the prior known cleaning system required an acid pump and circulation of acidic fluid. The present invention, on the other hand, is operable through the existing components of the heat pump 12 on a regular or periodic basis without the need for additional equipment to be attached to the fluid conduits, or the introduction of acidic fluids. The cleaning cycle control system 10 includes electronic controls that are connectable to existing controls of commonly used commercial or residential heat pumps. The cleaning cycle control system 10 can be a software-based control system or a hardware based control system.

Figure 2:
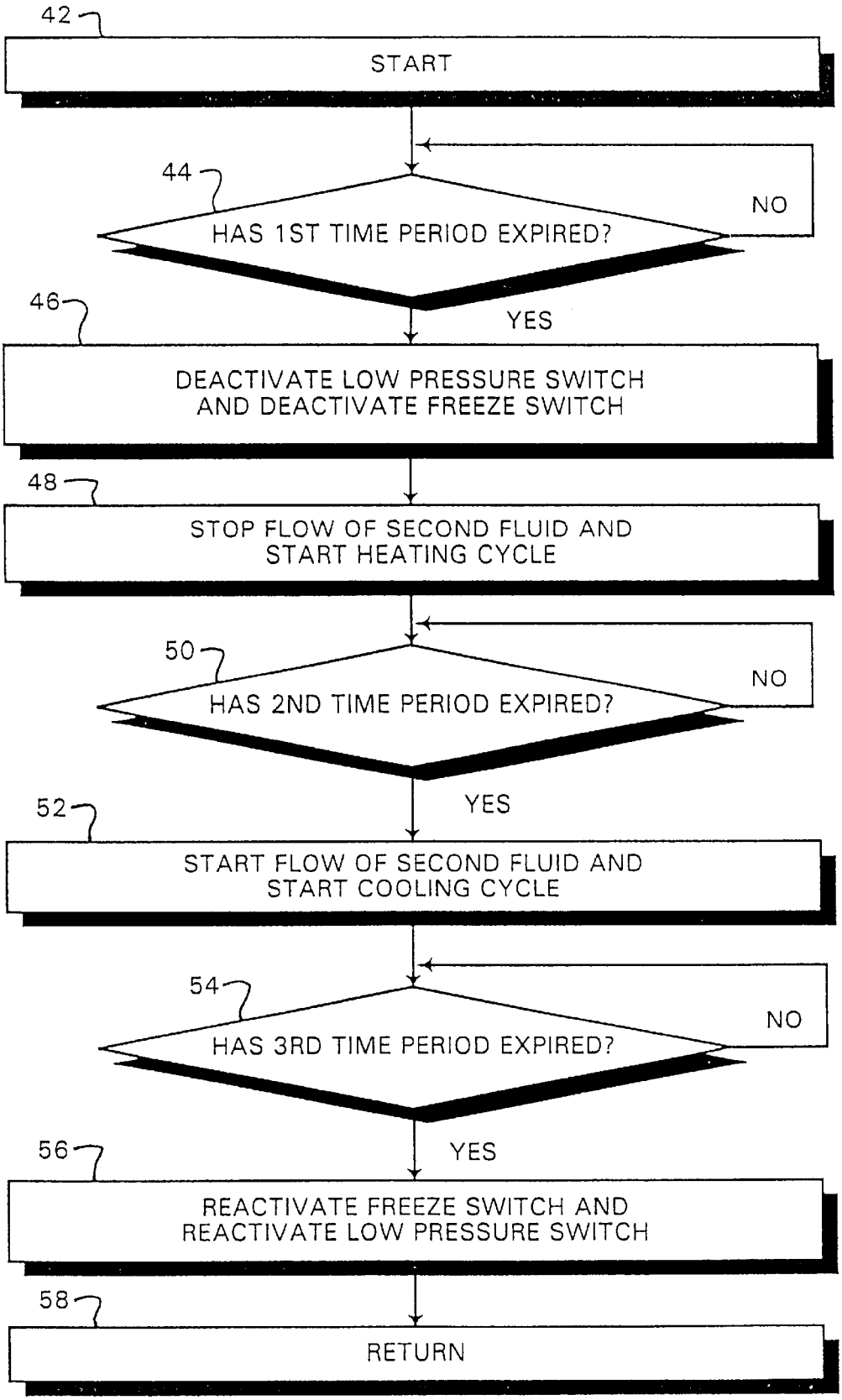
FIG. 2 is a simplified flow diagram illustrating steps performed during a cleaning process according to the present invention.

In either case, the process steps according to the present invention are shown in the simplified flow diagram of FIG. 2. The cleaning cycle control system 10 of the present invention can include an initiating means for cleaning the heat pump 12 automatically. The control starts at step 42. Step 44 monitors the time that the heat exchanger 14 operates. After a first predetermined period of time has passed, the cleaning cycle control system 10 will continue to the next step 46. If the first predetermined time period has not passed, the cleaning cycle control system 10 continues to monitor the period of time that the heat exchanger 14 has been in operation since the last cleaning cycle process. The preferred time period between cleaning depends on several factors including the size of the heat exchanger 14 and the relative amount of contaminants in the second fluid 32. The cleaning cycle control system 10 can clean the heat transfer wall 20 of the heat exchanger 14 every 500 hours of operation, every 2,000 hours of operation, or on any desired time interval. If desired, the cleaning cycle control system 10 can be activated more frequently than every 500 hours of operation. The cleaning cycle control system 10 of the present invention can be operated without an automatic cleaning cycle step 44. In step 46, the cleaning cycle control system 10 bypasses the low pressure switches 38*a* and 38*b*. If the heat pump 12 does not include low pressure switches 38*a* and 38*b*, step 46 is eliminated or skipped. Step 46 also bypasses the freeze switch 40. As with the low pressure switches 38*a* and 38*b*, if the heat pump 12 does not include a freeze switch 40, than step 46 is eliminated or skipped. Step 48 deactivates solenoid valve 33 and/or pump 34 in communication with the second fluid conduit 18 to stagnate the second fluid in the heat exchanger 14. The overall efficiency of the cleaning process is improved when the flow of second fluid is deactivated during the first part of the cleaning process.

Step 48 also engages the heating cycle of the heat pump 12 for a second predetermined period of time. During the heating cycle of the heat pump 12, heat is extracted from the second fluid 32 and absorbed by the first fluid 22. During the heating cycle, the second fluid 32 adjacent to the heat transfer wall 20 will lose heat and eventually begin to freeze if sufficient heat is removed. The deposits on the heat transfer wall 20 also begin to freeze. It is commonly believed that the freeze switch is required to prevent freezing of the second fluid 32 that can damage the heat exchanger 14. According to the present invention, controlled freezing of the second fluid 32 is desirable. By at least partially freezing the second fluid 32 and the deposits on the heat transfer wall 20, in combination with the thermal expansion and contraction that take place, it is believed that the deposits are caused to dislodge from the heat transfer wall 20. The freezing process is continued for a second predetermined period of time. Preferably, the second predetermined period of time lasts from about five minutes to about eight minutes inclusive. However, the second predetermined period of time can be shortened or lengthened depending on the size of the heat exchanger 14. The second predetermined period of time is selected to be sufficiently short to prevent any permanent damage the heat exchanger 14.

Step 52 activates the flow of the second fluid after the second predetermined period of time has elapsed. Step 52 also engages the cooling cycle of the heat pump 12. During the cooling cycle of the heat pump 12, heat is drawn from the first fluid 22 and absorbed by the second fluid 32. The second fluid 32 and the deposits on the heat transfer wall 20 begin thawing during the cooling cycle. Activating the flow of second fluid produces a flushing action within the heat exchanger 14. The flow of the second fluid 32 and the thawing process produced by the cooling cycle results in deposits breaking away from the heat transfer wall 20. Step 52 engages the cooling cycle for a third predetermined period of time. The third predetermined period of time typically can be three to four minutes and is measured by step 54. However, the cooling cycle can be as long or short as is desired provided that sufficient heat is supplied to the heat transfer wall to completely thaw and remove any frozen material before resuming normal operations. The operation of the cooling cycle poses no threat of damaging the heat exchanger 14. Step 56 reactivates the freeze switch 40. If the heat pump 12 does not include a freeze switch 40 than program step 56 can be eliminated or skipped. Step 56 also reactivates the low pressure switches 38*a* and 38*b*. If the heat pump 12 does not include low pressure switches 38*a* and 38*b*, step 58 can be eliminated or skipped. After step 56, the cleaning cycle control system 10 returns back to normal operation until the cleaning cycle is run again.

Figure 3:
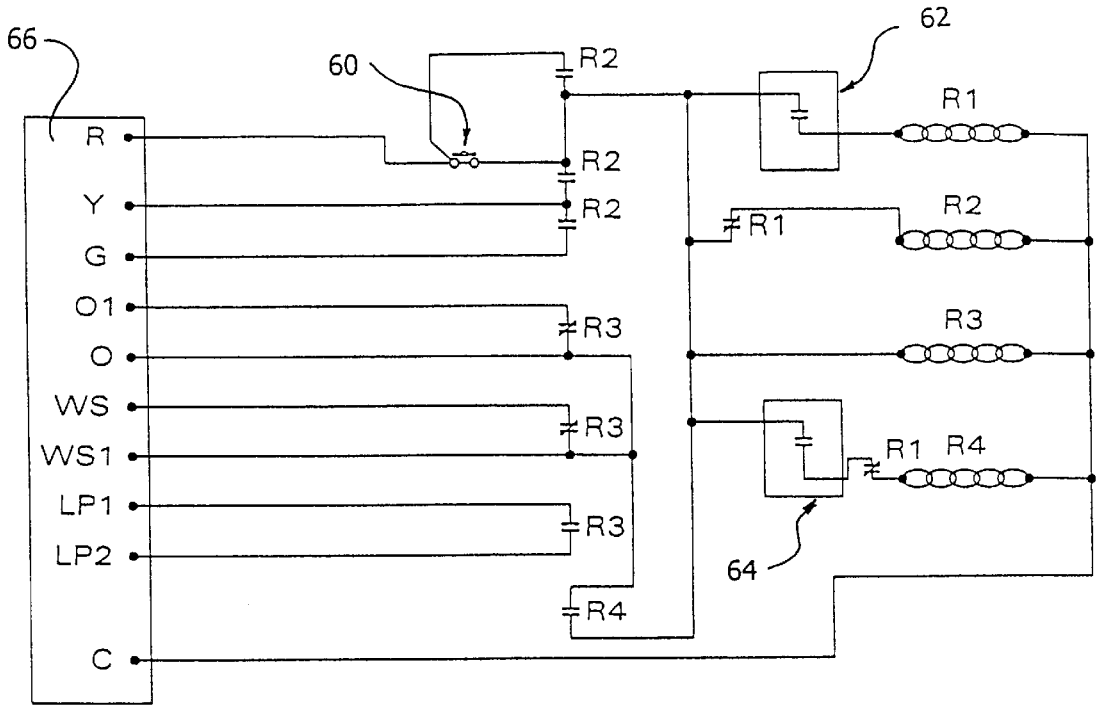
FIG. 3 is a circuit diagram for an electronic control according to the present invention.
Figure 4:
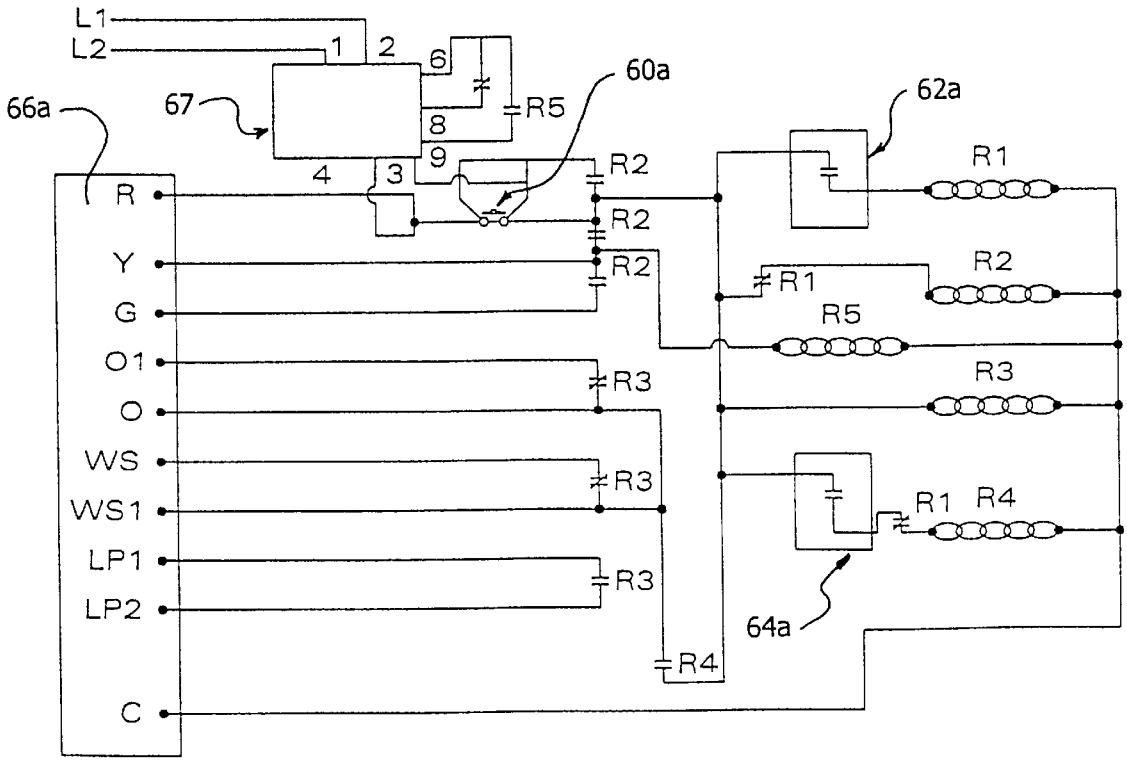
FIG. 4 is a circuit diagram for an electronic control according to the present invention with an automatic initiating means.

The cleaning cycle control system 10 of the present invention can include a hardware electronic control circuit as shown in FIGS. 3 and 4. FIG. 3 shows a circuit diagram of a hardware cleaning cycle control system 10. The cleaning cycle control system 10, according to the present invention, can include an activating switch 60, an adjustable time delay relay 62 capable of timing up to 10 minute intervals and an adjustable time delay relay 64 capable of timing up to 6 minute intervals. The circuit is wired as shown in FIG. 3 with suitable relay contacts R1, R2, R3, R4, R5, R6, R7, R8. This circuit connects to a microprocessor 66 for receiving the signals and controlling the compressor, reversing valve, and flow valve. FIG. 3 depicts a manually initiated cleaning cycle system. In FIG. 4, the cleaning cycle controller 10 of the present invention is shown with automatic initiation means for the cleaning cycle. The automatic initiation means can include an adjustable timer 67. The adjustable timer 67 of a hardware version of the cleaning cycle control system 10 functions to include step 44 of cleaning cycle control system 10 depicted in FIG. 2. The adjustable time delay relay 67 preferably is capable of timing up to 2000 hours of compressor operation between automatic cleaning cycles. The timer can be overridden by manual activation of a cleaning cycle with switch 60*a*.

Figure 5:
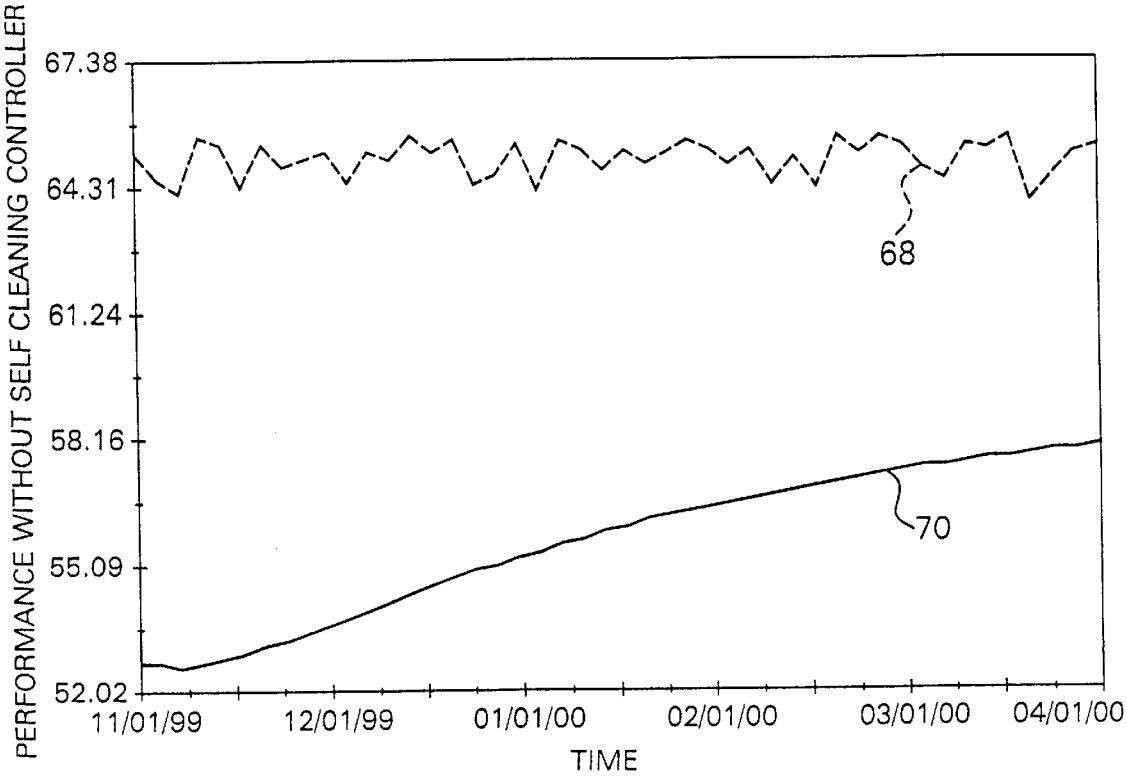
FIG. 5 is a graph showing the performance of a heat pump without a cleaning apparatus according to the present invention.

FIG. 5 is a graph showing the performance of a heat pump 12 in temperature (° F.) versus time without a cleaning cycle control system 10. Graph line 68 illustrates the water temperature of the second fluid 32 as the second fluid 32 enters the heat exchanger 14. Graph line 70 illustrates the temperature of the second fluid 32 as the second fluid 32 exits the heat exchanger 14. As the graph demonstrates, less heat is withdrawn from the second fluid 32 as time passes. This reduction in heat withdrawn from the second fluid 32 is caused by the accumulation of deposits on the heat transfer wall 20. The deposits interfere with the passage of heat between the first fluid 22 and the second fluid 32.

Figure 6:
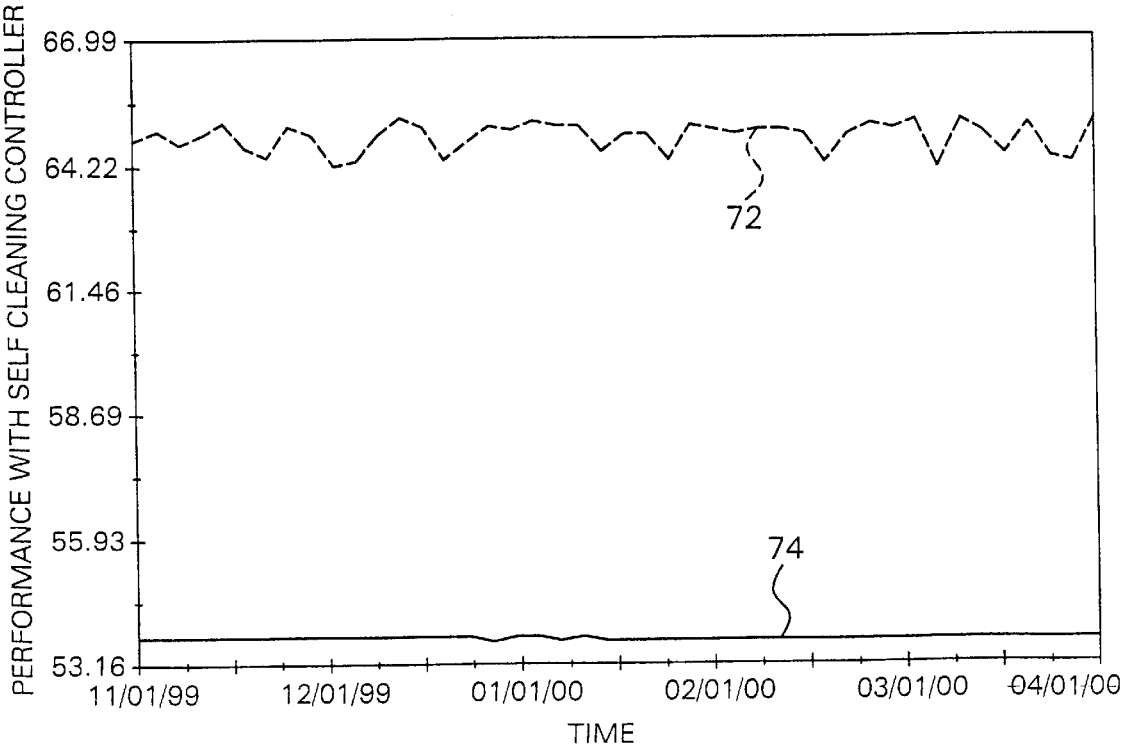
FIG. 6 is a graph showing the performance of a heat pump using a cleaning method according to the present invention.

FIG. 6 is a graph showing the performance of a heat pump 12 in temperature (° F.) versus time including a cleaning cycle control system 10. Graph line 72 illustrates the temperature of the second fluid 32 as the second fluid 32 enters the heat exchanger 14. Graph line 74 illustrates the temperature of the second fluid 32 as the second fluid 32 exits the heat exchanger 14. As the graph demonstrates, the amount of heat withdrawn from the second fluid 32 remains constant over 5 months of operation. The graph of FIG. 6 illustrates a preferred performance for the heat exchanger 14.

The preferred form of heat pump 12, according to the present invention, is a geothermal heat pump. However, the present invention can include any form of heat exchanger known in the art having control means 36 for controlling the flow of the first fluid 22 through a first fluid conduit 16 and controlling the flow of a second fluid 32 through a second fluid conduit 18, each of the first and second fluids passing through a heat exchanger 14 and separated by a heat transfer wall 20.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for removing deposits from a heat exchanger having at least one heat transfer wall disposed between a first fluid conduit, and a second fluid conduit for transporting a heat sink liquid, the apparatus comprising:

control means for controlling fluid flow through the first and second fluid conduits in order to selectively operate in one of a heating cycle, and a cooling cycle; and a cleaning control system connectible to the control means for defining a cleaning cycle, each cleaning cycle actuated through operation of the control means, the cleaning cycle periodically removing deposits from at least one side of the at least one heat transfer wall extending between the first and second fluid conduits through the heat exchanger by at least partially freezing and then thawing the heat sink liquid located adjacent to the at least one heat transfer wall.

2. The apparatus of claim 1, wherein the cleaning cycle flushes deposits from the second conduit with at least partially frozen liquid.

3. The apparatus of claim 2, wherein the cleaning cycle reduces fluid flow through the second conduit during at least part of the cleaning cycle to partially freeze the stationary fluid, and increases fluid flow through the second conduit during at least another part of the cleaning cycle after a predetermined time period of freezing.

4. The apparatus of claim 1, wherein the cleaning cycle disengages a freeze switch of the heat exchanger.

5. The apparatus of claim 1, wherein the cleaning cycle is automatically initiated after the heat exchanger has operated for a predetermined time period.

6. The apparatus of claim 1, wherein the first fluid conduit further comprises:

a closed loop conduit for circulating a refrigerant in either direction to create desired phase changes of the refrigerant between gas and liquid stages for transferring heat.

7. The apparatus of claim 6, wherein the refrigerant is selected from the group consisting of freon, ammonia, water, air, methylene chloride, methyl chloride, sulphur dioxide, propane, ethane, ethyl chloride and carbon dioxide.

8. The apparatus of claim 6 further comprising:

means for compressing a first fluid flowing through the first fluid conduit; and means for expanding the first fluid.

9. The apparatus of claim 1, wherein the second fluid conduit comprises:

an open loop conduit for circulating the heat sink liquid between a fluid inlet and a fluid outlet.

10. The apparatus of claim 9, wherein the heat sink liquid is selected from the group consisting of water, coolant and mixtures thereof.

11. The apparatus of claim 1, wherein the cleaning cycle removes heat from the second fluid conduit to at least partially freeze liquid adjacent the at least one heat transfer wall of the second fluid conduit of the heat exchanger.

12. The apparatus of claim 1 further comprising:

timer means for tracking time periods for each of a series of deposit removal steps to be performed.

13. A method for removing deposits from a heat exchanger having at least one heat transfer wall disposed between a first fluid conduit and a second fluid conduit for transporting a heat sink liquid, the method comprising the steps of:

controlling fluid flow through the first and second fluid conduits in order to selectively operate in one of a heating cycle, and a cooling cycle with control means; and periodically removing deposits from at least one side of the at least one heat transfer wall extending between the first and second fluid conduits through the heat exchanger by at least partially freezing and then thawing the heat sink liquid located adjacent to the at least one heat transfer wall with a cleaning control system connectible with the control means for defining a cleaning cycle.

14. The method of claim 13 further comprising the step of:

disengaging a freeze switch of the heat exchanger.

15. The method of claim 13 further comprising the step of:

automatically actuating the cleaning cycle after the heat exchanger has operated for a predetermined time period.

16. The method of claim 13 further comprising the steps of:

removing heat from the second fluid conduit to at least partially freeze liquid adjacent the at least one heat transfer wall of the second fluid conduit through the heat exchanger.

17. The method of claim 13 further comprising the step of:

reducing fluid flow through the second fluid conduit while actuating the heating cycle; and increasing fluid flow through the second fluid conduit while actuating the cooling cycle.

18. The method of claim 13, wherein the controlling step further comprises the step of:

circulating refrigerant through a closed loop of the first conduit.

19. The method of claim 13, wherein the controlling step further comprises the step of:

circulating the heat sink liquid through an open loop of the second conduit.

20. An apparatus for removing deposits from a heat exchanger having at least one heat transfer wall disposed between a first fluid conduit, and a second fluid conduit for transporting a heat sink liquid, the apparatus comprising:

means for controlling fluid flow through the first and second fluid conduits for selectively operating in one of a heating cycle and a cooling cycle; and means for periodically removing deposits from at least one side of the at least one heat transfer wall extending between the first and second fluid conduits through the heat exchanger by at least partially freezing and then thawing the heat sink liquid located adjacent to the at least one heat transfer wall with a cleaning control system connectible to the controlling means for defining a cleaning cycle.

21. A cleaning cycle control system for a heat pump having a heat exchanger with at least one heat transfer wall including first and second surfaces on opposite sides of the wall, the wall disposed between a refrigerant fluid conduit for selectively conveying refrigerant fluid in either flow direction across the first surface of the wall and a heat sink liquid conduit for selectively conveying heat sink liquid in a flow direction across the second surface of the wall, the heat pump selectively operable in a heating cycle, where the refrigerant fluid flows in a first direction across the first surface while the heat sink liquid flows across the second surface, and a cooling cycle, where the refrigerant fluid flows in a second direction across the first surface while the heat sink liquid flows across the second surface, the cleaning cycle control system comprising:

a controller for initiating a cleaning cycle, where the refrigerant fluid initially flows across the first surface in the first direction while heat sink liquid flow is substantially reduced to initiate freezing of the heat sink liquid adjacent to the second surface for a first period of time, after the first period of time expires, the refrigerant fluid is then reversed to flow across the first surface in the second direction while the heat sink liquid flow is reestablished to initiate thawing of the heat sink liquid frozen adjacent to the second surface for a second period of time, wherein the freezing and thawing of the heat sink liquid adjacent the second surface of the wall loosens and dislodges accumulated deposits formed on the second surface thereby automatically cleaning the second surface to increase operational efficiency of the heat exchanger.

* * * * *